US005535767A

United States Patent [19]

Schnatzmeyer et al.

[11] Patent Number: 5,535,767

[45] Date of Patent: Jul. 16, 1996

[54] REMOTELY ACTUATED ADJUSTABLE CHOKE VALVE AND METHOD FOR USING SAME

[75] Inventors: Mark A. Schnatzmeyer, Lewisville; Joseph L. Pearce, Dallas, both of Tex.

[73] Assignee: Halliburton Company, Houston, Tex.

[21] Appl. No.: 404,211

[22] Filed: Mar. 14, 1995

[51] Int. Cl.[6] ..... F04F 1/20

[52] U.S. Cl. ..... 137/1; 137/155; 417/109

[58] Field of Search ..... 137/1, 155; 417/109

[56] References Cited

U.S. PATENT DOCUMENTS

| | | | |
|---|---|---|---|
| 2,366,175 | 1/1945 | Boynton | 137/155 X |
| 2,368,406 | 1/1945 | Boynton | 137/155 X |
| 2,371,220 | 3/1945 | Boynton | 417/109 |
| 3,427,989 | 2/1969 | Bostock et al. . | |
| 5,176,164 | 1/1993 | Boyle | 137/155 |

OTHER PUBLICATIONS

*Guide to Otis Versa–Trieve Packers,* 1988, author unknown.

*Primary Examiner*—Gerald A. Michalsky
*Attorney, Agent, or Firm*—William M. Imwalle; Charles W. Gaines

[57] ABSTRACT

A remotely-adjustable valve employable in an enhanced-lift recovery system and a method of adjusting the same. The valve comprises: (1) an elongated valve body having a process fluid inlet and a process fluid outlet, (2) an elongated valve stem disposed within the valve body for axial displacement relative thereto to adjust a rate of process fluid flow between the fluid inlet and the fluid outlet as a function of a relative axial position of the valve stem with respect to the valve body and (3) a cam disposed within the valve body and coupling the valve body and the valve stem, the cam providing a plurality of axial displacement positions thereon to place the valve stem at a selected one of a plurality of relative axial positions with respect to the valve body, the valve body having a control fluid pressure port for allowing a control fluid pressure to be introduced into and released from the valve to reciprocate the valve stem axially with respect to the valve body between cocked and set positions, the cam moving from a first axial displacement position to a second axial displacement position as the valve stem is reciprocated, a difference between the first and second axial displacement positions thereby causing an adjustment of the rate of process fluid flow between the fluid inlet and the fluid outlet.

84 Claims, 7 Drawing Sheets

REMOTELY ACTUATED ADJUSTABLE CHOKE VALVE AND METHOD FOR USING SAME

TECHNICAL FIELD OF THE INVENTION

The present invention is directed, in general, to a choke valve, and more specifically, is directed to a remotely actuated adjustable downhole choke valve that may be used in the production and operation of a well.

BACKGROUND OF THE INVENTION

In producing liquids, including oil and water, from a geological formation, most wells initially have sufficient natural bottom hole pressure to efficiently lift the liquids up to the ground surface. However, over a period of time, this natural bottom hole pressure declines, thus requiring artificial steps to improve lift. One commonly known method of augmenting lift is to inject gas into the production tubing. This injection is usually done by forcing gas down the annulus between the production tubing, which conducts liquid to the surface, and the casing of the well. The gas is constrained to flow through a gas flow control device at the desired depth into the production tubing. The gas bubbles mix with the liquids and reduce the overall density of the mixture. With the liquid's density reduced, the diminished natural bottom hole pressure is then able to lift the liquid to the surface. This injection of gas into the well requires the operation of a gas lift control valve that regulates the injection of gas flow into the tubing.

In conventional applications, various types of lifting gas injection control valves can be utilized. Among the simplest of these is the orifice valve, which consists of a specifically-sized orifice insert mounted in the valve body and a back-flow check. The size of the orifice used is normally chosen based on calculated or estimated parameters, and therefore may or may not prove to be optimal in the actual application. Furthermore, in order to confirm whether or not the chosen orifice size is optimal, it may be necessary to remove and replace the valve one or more times using different orifice sizes to compare well performance data. Each act of removing and replacing the valve requires an interruption of well production as well as a period of time for the well to re-stabilize before useful comparative production data can be obtained. Additionally, an artificial-lift well whose reservoir characteristics are of a transient nature may require regular changing of the lifting valve orifice in order to maintain optimal conditions. A significant disadvantage with this system is that several trips into and out of the hole have to be conducted to achieve the proper setting. These multiple trips are, of course, time consuming and costly.

The operating valve of an artificial lift installation is normally intended to regulate or restrict the flow of injection gas from the casing into the production tubing and allow the flow of injected in response to either a preselected pressure condition or control from the surface. A difficulty inherent in the use of gas lift valves which are either fully open or closed is that gas lift production completions are closed fluid systems which are highly elastic in nature due to the compressibility of the fluids and the frequently large depth of the wells. For this reason, and especially in the case of dual completion wells, the flow of injected gas through a full open gas lift valve may produce vibrations at a harmonic frequency of the closed system and thereby create resonant oscillations in the system generating extremely large and destructive forces within the production equipment. Gas lift valves of a particular size aperture positioned at a point of resonance within the well completions(s) may have to be replaced in order for the system to be operable.

Another application of downhole fluid control valves within a production well is that of chemical injection. In some wells, it becomes necessary to inject a flow of chemicals into the borehole in order to treat either the well production equipment or the formation surrounding the borehole. The introduction of chemicals through a downhole valve capable of only fully open or fully closed positions does not allow precise control over the quantity of chemicals injected into the well.

Another application of downhole flow control valves is that of a dual completion gas lift operation in a well. By varying the orifice size of the gas injection valve the differential pressure drop across the gas lift valve can be controlled so that the pressure of the gas inside each string of tubing at the injection valve can be matched with the needs of that particular formation. However, flow control valves capable of only fully open or closed configurations contribute to imprecise control over the pressure drop. In addition, such systems also suffer from potential resonance due to oscillations generated by flow through the valve which may necessitate tuning the system in some fashion or replacement of the valve in order for the system to be operable.

Yet another application of downhole fluid control valves is in "auto lifting" applications. Auto lifting occurs where gas from one geological formation at a relatively higher pressure is used to supply the lifting energy to the liquids from a separate formation, all within the same wellbore.

As mentioned above, prior art flow control valves for downhole applications, such as gas lift valves, include a number of inherent disadvantages. A first disadvantage is having a single size flow orifice in the open condition which may produce resonant oscillations resulting in destructive effects within the well. A second disadvantage is that of being capable of assuming only a fully open or fully closed position which requires the shuttling of the valve between these two positions at high pressures and results in tremendous wear and tear on the valves. Such wear requires frequent maintenance or replacement of the valves which is extremely expensive.

Another type of valve utilized in gas lift applications is a hydraulic actuated valve that is generally controlled from the surface. By controlling the flow of a hydraulic fluid from the surface, a poppet valve is actuated to control the flow of fluid into the gas lift valve. The valve is moved from a closed position to an open position for as long as necessary to effect the flow of the lift gas. Such valves are also position instable, that is upon interruption of the hydraulic control pressure, the gas lift valve returns to its normally closed configuration. Other hydraulically actuated downhole flow control valves also include certain inherent disadvantages as a result of their long hydraulic control lines which result in a delay in the application of control signals to a downhole device. For example, in applications involving hydraulically driven motors or pistons, the precise flow of hydraulic fluid necessary to adjust the valve to essential critical tolerances is often difficult to achieve due to the hysteresis that develops in a hydraulic system that spans substantial well depths. Another complicating factor is the hydraulic head that is present at those same well depths. At such depths, the pressure attributable to the head of hydraulic fluid can become quite significant, which makes the setting of the valve more difficult because of the added hydraulic pressure that must be compensated for when adjusting the valve. These problems exist primarily because the point of fine tuning for the valve depends on the flow of hydraulic fluid that is controlled from the distant surface, and for the reasons stated above, fine tuning adjustment to the valve is difficult to achieve.

To overcome some of the above-described disadvantages, electrically controlled gas lift valves have been developed. However, some of these valves, such as the one disclosed in U.S. Pat. No. 3,427,989, also suffer from disadvantages of position instability and operation based upon either fully open or fully closed conditions. Another electrical valve, which is disclosed in pending U.S. application, Ser. No. 08/218,375 and is incorporated herein by reference, addresses many of the problems suffered by prior electrical control valves by providing an electrical valve that allows the adjustment of a variable orifice size valve by means of signals from the surface. While these valves are well suited for their intended use, they are more expensive and complex in their design than the conventional hydraulic valves discussed above.

Thus, it is apparent that there is a need in the art for an inexpensive, simply designed, fluid actuated control valve in which the orifice size of the valve is adjustable through a range of values that would enable gas lift systems, which are susceptible to resonant oscillation, to be detuned by adjusting the size of the orifice to dissipate the resonant oscillations. Such a variable orifice valve would allow much greater control over the quantity and rate of injection of fluids into the well. In particular, more precise control over the flow of injection gas into a dual lift gas lift well completion would allow continuous control of the injection pressure in both strings of tubing from a common annulus, which would result in more efficient production from the well.

There is also a need in the art for a fluid actuated control valve that would be position stable; that is, it would be able to set a flow control valve at a particular orifice size and to have it remain at that same orifice size until selectively changed to a different size without the need for well intervention to change the orifice size, i.e., pulling the valve. There is also a need in the art for a fluid actuated control valve that is able to monitor not only the orifice size of the valve but also the pressures and flow rates within the production system in order to obtain desired production parameters within the well.

The fluid actuated flow control valve system of the present invention provides a valve system that addresses the deficiencies of the prior art valves.

SUMMARY OF THE INVENTION

To address the above-discussed deficiencies of the prior art, it is a primary object of the present invention to provide a remotely-adjustable hydraulically-actuated valve that overcomes both the sensitivity of prior art remotely-adjustable hydraulically-actuated valves to inevitable variations in hydraulic pressure and response times and the sheer complexity and cost of prior art remotely-adjustable electrically-actuated valves.

In the attainment of the above-described primary object, the present invention provides a remotely-adjustable valve employable in an enhanced-lift recovery system and a method of adjusting the same. The valve comprises: (1) an elongated valve body having a process fluid inlet and a process fluid outlet, (2) an elongated valve stem disposed within the valve body for axial displacement relative thereto to adjust a rate of process fluid flow between the fluid inlet and the fluid outlet as a function of a relative axial position of the valve stem with respect to the valve body and (3) a cam disposed within the valve body and coupling the valve body and the valve stem, the cam providing a plurality of axial displacement positions thereon to place the valve stem at a selected one of a plurality of relative axial positions with respect to the valve body, the valve body having a control fluid pressure port for allowing a control fluid pressure to be introduced into and released from the valve to reciprocate the valve stem axially with respect to the valve body between cocked and set positions, the cam moving from a first axial displacement position to a second axial displacement position as the valve stem is reciprocated, a difference between the first and second axial displacement positions thereby causing an adjustment of the rate of process fluid flow between the fluid inlet and the fluid outlet.

As mentioned above, prior art flow control valves for downhole applications, such as gas lift valves, include a number of inherent disadvantages. A first of these is having a single size orifice in the open condition that may produce resonant oscillations resulting in destructive effects within the well. The single size orifice of these prior art valves further requires a lengthy and expensive trial and error process of running a valve having a fixed orifice of a given size, allowing the well to reach a steady state, determining production rate and repeating the first three steps to determine production rate as a function of the orifice size to optimize production from the well.

A second disadvantage of some prior art hydraulically-actuated valves is that of being capable of assuming only a full open or full closed position, requiring that shuttling of the valve between these two positions at high pressures and results in significant wear on the valves. Such wear requires frequent maintenance or replacement of the valves, which is expensive. Prior art hydraulically-actuated downhole flow control valves also include certain inherent disadvantages as a result of their long hydraulic control lines, resulting in a hysteresis in the application of control signals to the downhole valve. In addition, the prior art valves did not accommodate telemetry circuitry to relay information from the valve to controls at the surface.

The present invention overcomes the disadvantages of these prior art hydraulically-actuated valves by providing a hydraulically-actuated valve having an orifice that is adjustable through a range of discrete sizes. This enables systems, such as gas lift systems which are susceptible to resonant oscillation, to be detuned by adjusting the size of the orifice so that the system is no longer resonant. In addition, an adjustable orifice allows control over the quantity and rate of injection of fluids into the well. In particular, more precise control over the flow of injection gas into a dual lift gas lift well completion would allow continuous control of the injection pressure in both strings of tubing from a common annulus. This permits controls of production pressures and flow rates within the wells and results in more efficient production from the well.

In stark contrast to the conventional hydraulically-actuated valves, the present invention employs a novel cam arrangement that removes any sensitivity of the valve to the variations or delays in hydraulic pressure that plagued those valves. The cam translates a simple on-off application of hydraulic pressure into valve stem reciprocation and a transition between predetermined discrete valve positions. Thus, variations or delays that would have resulted in erroneous flow rates in the prior art valves instead are of no effect whatsoever.

In the past, it was felt that only electrically-actuated valves possessed the requisite controllability to overcome the disadvantages of hydraulically-actuated valves. However, the present invention demonstrates that predictable hydraulic control is an excellent alternative to the electrically-actuated valves disclosed in the prior art.

Another desirable characteristic of a downhole flow control valve system is that of position stability of the flow control orifice. That is, it would be highly useful to be able to set a flow control valve at a particular orifice size and to have it remain the same until selectively changed to a different size. Position stability is preferable in the absence of any control signals to the valve so that applied power is only necessary to change the orifice from one size to another. The valve of the present invention employs defined axial displacement positions on the cam to ensure that the valve stem remains at its position in the absence of hydraulic pressure. Pressure is applied only to transition the valve to another size.

In a preferred embodiment of the present invention, the cam is rotatable and provided with a J-slot about a circumference thereof, the J-slot adapted to receive a follower therein to govern the relative axial position of the valve stem with respect to the valve body, the J-slot having a plurality of intermediate passages coupling the plurality of axial displacement positions. As will be described, the J-slot cooperates with a follower to place the follower in a selected axial position when the follower is shifted axially with respect to the J-slot. The present invention makes notably advantageous use of the J-slot concept to provide predictable control of a valve.

In a preferred embodiment of the present invention, the valve further comprises a follower coupling the valve body to the cam. Thus, the follower traverses the J-slot when the valve stem is reciprocated with respect to the valve body. In such an arrangement, the cam is axially fixed with respect to the valve stem, although it is free to rotate. In the alternative, the cam may be axially fixed with respect to the valve body and the follower may be mounted to the valve stem. In either arrangement, the result is the same.

In a preferred embodiment of the present invention, the valve stem comprises a differential piston that is reciprocable within a sleeve of the valve body and defining a control fluid chamber about the differential piston; introduction of the control fluid pressure into the control fluid chamber causes the valve stem to move into a cocked position. A differential piston is defined as a duality of spaced-apart pistons having different surface areas that are coupled to one another to move in the same direction. When pressure is applied to the space between the pistons, the pressure applies a larger force to the piston of larger surface area than to the piston of smaller surface area, causing both pistons to move in the direction of the force acting on the piston having the larger surface area. The present invention employs a differential piston to allow control fluid pressure to build to a significant level before effecting piston movement, thereby decreasing sensitivity of the valve to pressure anomalies or delays.

In a preferred embodiment of the present invention, the valve body and the valve stem define a compensation pressure chamber at an end distal to the process fluid outlet, the valve body including a compensation pressure port allowing fluid communication between the compensation pressure chamber and an environment surrounding the distal end. The environment surrounding the distal (usually the upper) end is typically the production tubing. Therefore, tubing pressure may be brought to bear against the valve stem. This tubing pressure counteracts process fluid inlet pressure (typically casing pressure) brought to bear in the opposite direction.

In a preferred embodiment of the present invention, the valve body and the valve stem define a compensation pressure chamber at an end distal to the process fluid outlet, the valve stem including a compensation pressure port allowing fluid communication between the compensation pressure chamber and an environment surrounding the process fluid inlet. In applications in which casing pressure is significantly greater than tubing pressure, the previously-described pressure compensation scheme may be inadequate to prevent the valve stem from floating in the valve body and therefore changing the orifice size. In such applications, the process fluid inlet pressure may be introduced into the compensation pressure chamber via the compensation pressure port to minimize any sensitivity tubing pressures. Another benefit associated with this modification is that the upper chamber is exposed to the relatively cleaner injection gas environment of the casing rather than the often polluted production fluid environment of the tubing. Therefore, the interior of the valve is exposed to a relatively cleaner and contaminate free environment. In some instances, the fluid within the tubing may have components such as geological sedimentation, water and other substances such as corrosive minerals mixed in with the fluid, which may prevent the valve from functioning properly. The injection gas is, of course, free from these pollutants, which are not present to interfere with the valve's operation.

In a preferred embodiment of the present invention, the cam provides more than one displacement positions thereon. Thus, in the embodiment illustrated, the cam provides more positions, the maximum number of which is limited by the physical geometry and overall design of the valve, particularly the circumference of the cam and the width of the passages of the J-slot.

In a preferred embodiment of the present invention, the cam provides an axial displacement position in which the valve stem closes the valve. As will be described, the closed position is most useful for diagnostic purposes. In valves not provided with displacement sensors, provision of the closed position allows surface determination of the valve state. This is valuable if the position of the valve cannot be readily determined or has been forgotten.

In a preferred embodiment of the present invention, the valve body is operable to be disposed within a side pocket mandrel associated with a well flow conductor. Those of ordinary skill in the art are similarly familiar with the use of a side pocket mandrel to house a gas lift valve. The valve of the present invention is substantially the same length, the same diameter, and has the same center of gravity and mass as prior art valves. This is important in providing a wire line retrievable gas lift valve that can be used in deviated wells having a maximum deviation of approximately 70 degrees.

In a preferred embodiment of the present invention, the valve further comprises a spring biasing the valve stem toward a closed position with respect to the valve body. The spring counteracts any tendency of the valve stem to float, thereby increasing orifice size. Application of hydraulic pressure from the surface counteracts the force of the spring, allowing the valve stem to reciprocate and set at a different axial position and orifice size.

In a preferred embodiment of the present invention, the valve further comprises a remote source of controllable hydraulic pressure coupled to the control fluid pressure port, the remote source capable of establishing and interrupting a prescribed pressure to reciprocate the valve stem within the valve body. As previously described, the present invention merely requires an intermittent source of hydraulic pressure exceeding a threshold minimum pressure. The actual pressure and the rate at which the pressure is applied are not material to operation of the valve, as long as the pressure is sufficient to reciprocate the valve stem.

In a preferred embodiment of the present invention, the valve further comprises a sensor for relaying data concerning the valve to a remote location, the sensor selected from the group consisting of: (1) a tubing pressure transducer and (2) a valve stem axial displacement transducer.

Another significant advantage that is highly desirable in downhole flow control valve systems is that of an accurate system for monitoring not only the orifice size of the valve but the pressure of the production tubing to obtain desired production parameters within the well. For example, it is advantageous to select a particular bottom hole pressure and then control the size of the orifice of the valve to obtain that selected value of bottom hole pressure. Such systems require a reliable means for both sending data uphole from the vicinity of the valve as well as processing that data and then actively controlling the size of the flow control orifice of the valve to obtain the desired results, as monitored by the system.

In this preferred embodiment, the valve provides transducers for sensing the displacement of the valve stem (and hence orifice size) and the tubing pressure. Of course, other sensors, such as a flow rate transducer, are within the broad scope of the present invention.

In a preferred embodiment of the present invention, the process fluid inlet communicates with a casing of a subterranean well. Thus, casing pressure preferably forces a process fluid in the casing through the valve of the present invention. In gas lift systems wherein gas is forced through tubing central to the casing to allow production through the casing, the process fluid inlet would communicate instead with the tubing.

In a preferred embodiment of the present invention, the process fluid outlet communicates with production tubing located within a casing of a subterranean well. Thus, the process fluid preferably proceeds from the valve into the production tubing through the valve of the present invention. In gas lift systems wherein gas is forced through tubing central to the casing to allow production through the casing, the process fluid outlet would communicate instead with the casing.

In a preferred embodiment of the present invention, the valve further comprises a check valve to prevent substantial process fluid flow from the process fluid outlet to the process fluid inlet. The check valve disallows backflow through the valve.

In a preferred embodiment of the present invention, first and second annular seals disposed about the valve body cooperate with a mandrel surrounding the valve body to create an annular chamber to receive a control fluid for introduction into the valve via the control fluid pressure port. As previously described, the valve of the present invention preferably resides within a side pocket mandrel. Rather than running a hydraulic hose with the valve, the valve may preferably be lowered into a mandrel having an integral hydraulic pressure port. The valve is sealingly engaged with the pressure port, allowing fluid pressure developed in the port to reciprocate the valve stem.

In a preferred embodiment of the present invention, the valve further comprises a running/pulling tool coupled to an end of the valve body distal to the process fluid outlet, the valve removably locatable in a mandrel within a subterranean well. The running/pulling tool allows the valve to be set in place and retrieved if desired. Often, it is advantageous to replace the valve of the present invention with a valve having a fixed orifice size once the valve of the present invention is used to determine the optimum orifice size.

In a preferred embodiment of the present invention, the valve is located in a side pocket mandrel associated with production tubing in a subterranean well, a casing surrounding the production tubing adapted to receive a process fluid and transfer the process fluid to within the production tubing at tile rate of process fluid flow via the valve. As those of ordinary skill in the art recognize, this represents an advantageous environment for operation of the valve of the present invention.

In a preferred embodiment of the present invention, the process fluid is a gas. Those of ordinary skill in the art will understand that the valve of the present invention may also meter the flow of liquids from the casing into the production tubing.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
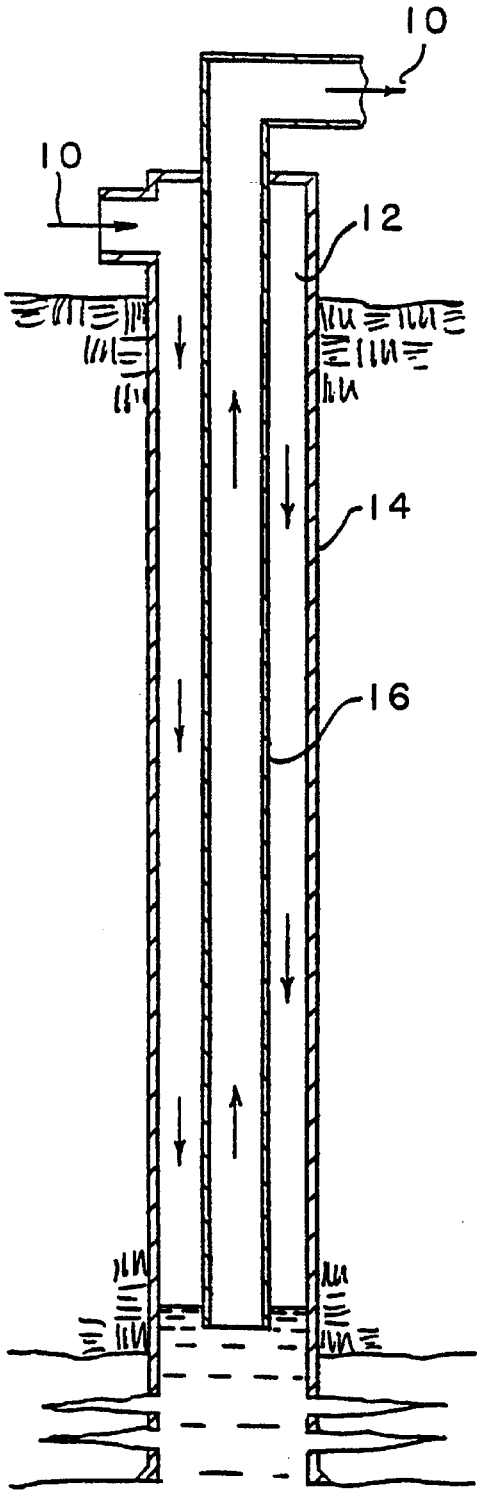
FIG. 1 (PRIOR ART)
FIG. 1 illustrates a schematic side cross-sectional view of a prior art gas lift system.

Turning initially to FIG. 1 there is illustrated a schematic cross-sectional view of a conventional gas lift configuration used in the production of an oil well. Generally, when a reservoir is first produced, there is sufficient natural pressure within the reservoir to push the liquids to the surface and efficiently produce the well. However, after a period of time, the natural formation pressure is abated, and while there is still natural pressure within the reservoir, it is no longer adequate to lift the liquids to the surface. In such instances, a gas lift system is often employed. Gas 10, represented by the arrows, is injected into the annulus 12 between the well casing 14 and the production tubing 16. The gas 10 mixes with and reduces the density of the liquids, which allows the remaining natural pressure to push the less dense liquids to the surface and, thereby, commercially produce the well. It should be understood that the configuration illustrated in FIG. 1 is an open end tubing configuration and is representative in nature only and that various conventional gas lift configurations and apparatus are well known. For example, various types of gas lift valves that control the flow of gas from the casing to the tubing are typically employed and are positioned within a conventional mandrel pocket (not shown). The casing and tubing are placed in fluid communication with one another via the gas lift valve when the valve is in an open position.

Figure 2:
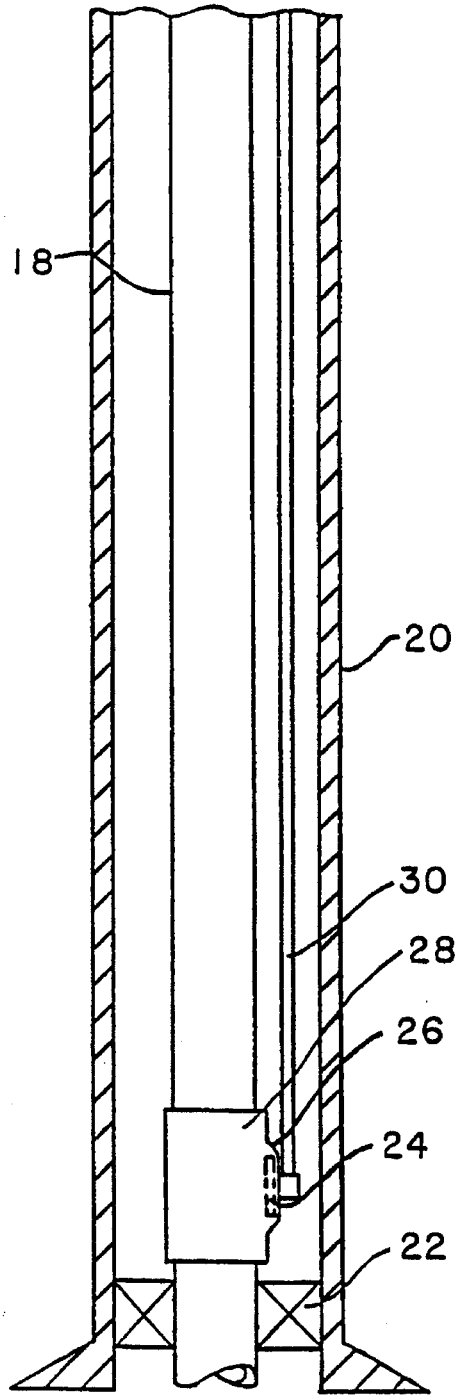
FIG. 2 illustrates a schematic cross-sectional view of the fluid actuated control valve, shown in phantom, positioned within a side-pocket mandrel in relation to the casing and tubing.

Turning now to FIG. 2, there is illustrated a schematic view of the elongated valve assembly of the present invention. In this figure, the production tubing 18 is positioned within the casing 20 and centralized with conventional packers 22. The valve assembly 24, shown in phantom, is positioned within a mandrel pocket 26 in the interior of the mandrel 28. Though the mandrel 28 may have various configurations, it is preferred that the mandrel 28 is a threaded collar member that can be threadedly attached to the production tubing 18. The mandrel pocket 26 is located within the interior of the mandrel 28 and is configured to securely hold the valve assembly 24 in a manner hereinafter described. Connected to the exterior of the mandrel 28 and in fluid communication with the valve assembly 24 is a fluid control line 30 that extends to the surface. The fluid control line 30 serves as a conduit through which the control fluid flows to actuate the valve assembly 24. As used herein, the term control fluid is intended to include liquids, such as hydraulic fluids, gas, and similar type fluids. By conventional means, the fluid flow may be controlled from the surface to remotely adjust and actuate the valve assembly 24.

The control line 30 may also include a "T" on a manifold connected to a container (not shown) at the surface with a velocity check (not shown) also on the control line 30. The "T", container and velocity check can aid in controlling pressure increases in the control line 30 that are the result of increases in temperature of the control fluid within the control line 30. Thus, as the pressure of the control fluid increases, the control line fluid can be released into the container at the "T" on the manifold. Even without such a "T" on the manifold, or other similar mechanism to relieve buildup of pressure, the valve assembly 24 of the present invention handles a limited change in pressure in the control line 30 because the valve will not move to an open position until the spring force is overcome by the pressure from the control line 30.

Hydraulic-pressure actuation of the valve assembly 24 is certainly viable, and may have some advantages over gas. However, in certain applications, using gas as the control fluid, in place of hydraulic fluids, has certain advantages. One such advantage is that using gas minimizes static fluid head in the control line, which, in turn, allows the use of a lighter spring within the valve. Due to the presence of the hydraulic fluid in the control line between the valve and the surface, the hydrostatic head has the effect of limiting certain performance parameters. For example, because of the presence of the hydrostatic head a heavier spring must be used in the valve. It follows that if the control line static pressure head can be minimized, the performance envelope of the valve can be expanded (performance envelope meaning the range of conditions in which the device can be utilized). Additionally, there is practically no limit to the depth at which a particular valve could be run, and the change in pressure in the control line caused by an increase in temperature would tend not to shift the valve if gas were used as a control line fluid, since the gas would be more readily compressed. Another advantage of using gas is that pressure activation response time (i.e., the time required for the entire system to equalize after application of pressure at the surface) would be much faster both for pressurization and bleed-off of the control line, due to the viscosity differences in the medium.

Figure 3:
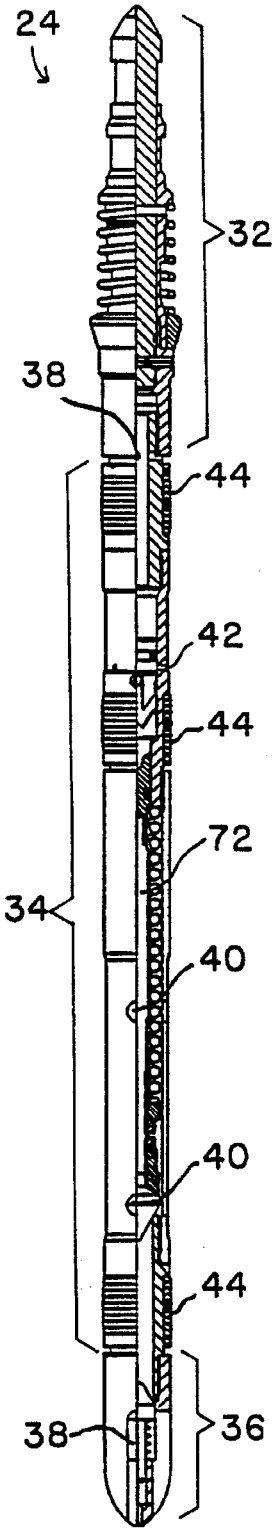
FIG. 3 illustrates a partial cut-away, cross-sectional view of an overall view of the valve.

Turning now to FIGS. 3 and 3A through 3D, there is illustrated a preferred embodiment of the elongated valve assembly 24 of the present invention. To show the detail necessary for a detailed discussion, the valve assembly 24 is illustrated in four views, 3A through 3D. Thus, it is understood that FIGS. 3A–3D collectively illustrate the entire length of this particular embodiment of the valve assembly 24 as shown in FIG. 3. Basically, the valve assembly 24 is comprised of a latch assembly 32, an elongated valve body 34, which includes a valve mechanism, and a conventional check valve assembly 36. The valve body 34 has tubing fluid outlet ports 38, casing fluid inlet ports 40 and a control fluid port 42. Spaced along the length of the valve body 34 are a plurality of packing sections 44 that extend around the circumference of the valve body 34.

Figure 3A:
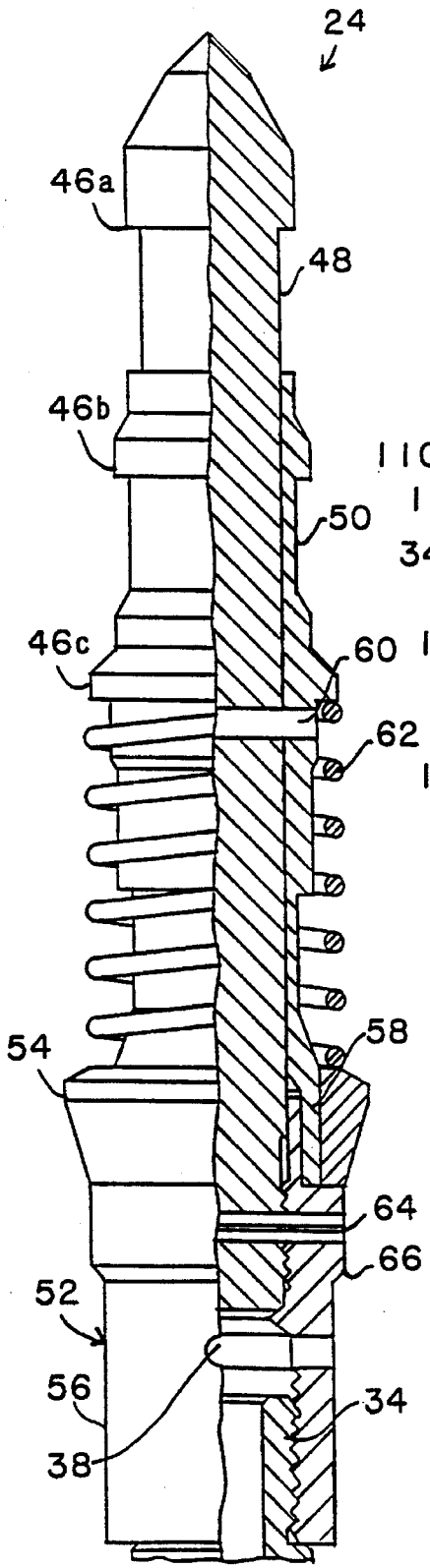
FIG. 3A illustrates a partial cut-away, cross-sectional view of one embodiment of the valve's upper portion having openings to the tubing.

Turning now to FIG. 3A for a more detailed discussion of the valve assembly 24, the conventional latch assembly 32 has a profile formed by first 46*a*, second 46*b* and third 46*c* shoulders. The profile shoulders 46*a*, 46*b* and 46*c* allow engagement of running and pulling tools that are used in setting the valve assembly 24 in place within the pocket mandrel. The valve assembly 24 may be set and retrieved by conventional methods such as a wireline. The latch assembly 32 is comprised of a central mandrel 48 received within a latching sleeve 50, both of which extend to a lock collar assembly 52, which is also a part of the latch assembly 32. The lock collar assembly 52 is comprised of a lock collar 54 and a threaded lock collar nipple 56. An end portion 58 of the latching sleeve 50 is received between the lock collar 54 and a portion of the lock collar nipple 56, which holds and centralizes the lock collar 54 with respect to the valve assembly 24. The lock collar 54 has an angled shoulder profile that engages a "crescent shape" matching profile formed in an interior wall of the mandrel pocket. When the valve assembly 24 is correctly positioned in the mandrel pocket, the lock collar 54 engages the mandrel's matching profile and locks the valve assembly 24 in the proper orientation and location with respect to the mandrel pocket.

A shear pin 60 extends through the latching sleeve 50 and the central mandrel 48. The shear pin 60 holds a spring 62 in a compressed position and prevents the spring 62 from biasing the latching sleeve 50 in an upward direction from the lock collar 54. If it is desired to remove the valve assembly 24 from the mandrel pocket, sufficient pulling force is exerted on the latching sleeve 50 to shear the shear pin 60. The latching sleeve 50 then moves upward from between the lock collar 54 and the lock collar nipple assembly 52, which allows the lock collar 54 to disengage from the matching profile within the mandrel pocket. The valve assembly 24 may then be removed from the mandrel pocket.

Positioned immediately below the lock collar 54 is a roll pin 64 that extends through the lock collar assembly 52 and into the central mandrel 48 to prevent rotation therebetween. A 45° step change no-go shoulder 66 is formed immediately under the lock collar 54 on the lock collar nipple 56. The "no-go" shoulder 66 serves two functions. First, it stops the downward motion of the valve assembly 24 as it is being inserted into the mandrel pocket. Second, the 45° profile matches a corresponding shoulder profile at the entrance of the mandrel pocket to properly locate the valve assembly 24 within the mandrel pocket. The tubing inlet port 38, which opens to the tubing, is formed in the lock collar assembly 54. The tubing inlet port 38 may allow process fluid from the tubing to enter and exit the valve body 34. The elongated valve body 34 that comprises a portion of the elongated valve assembly 24 is threadedly received in the end of the lock collar assembly 52 opposite that in which the central mandrel 48 is threadedly received.

Figure 3B:
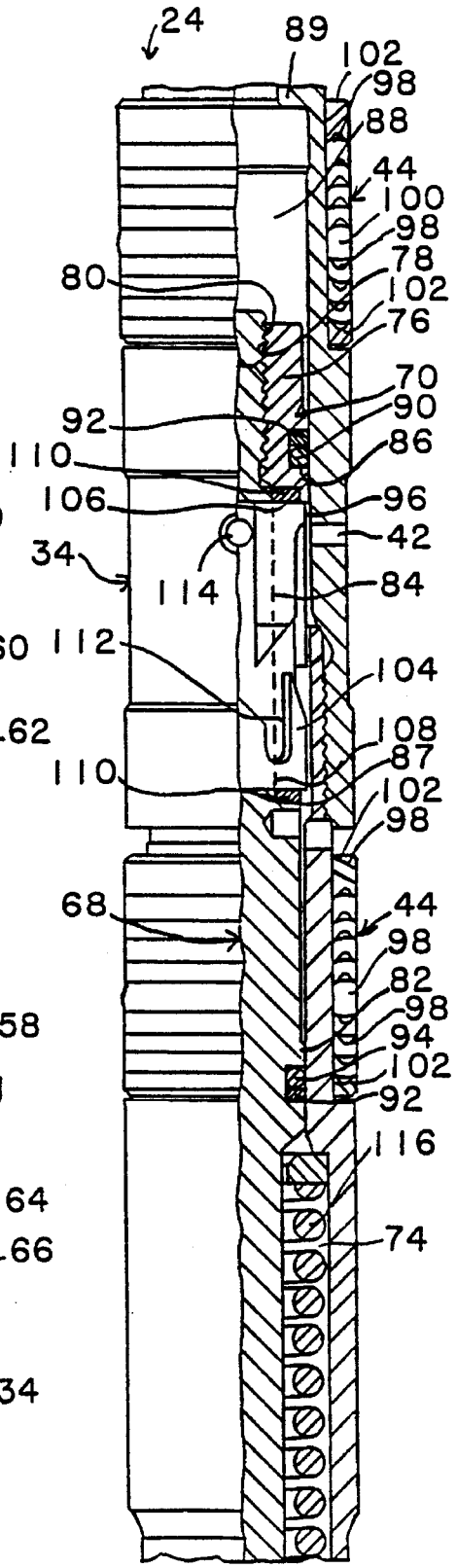
FIG. 3B illustrates a partial cut-away, cross-sectional view of the upper intermediate section of the valve illustrated in FIG. 3A.

Turning now to FIG. 3B, disposed within the valve body 34 is an elongated valve stem 68 that is axially displaceable within the valve body 34 and extends a substantial portion of the length of the valve body 34. The valve stem 68 is axially displaceable relative to the valve body 34 to adjust a rate of process fluid flow between the tubing fluid outlet ports 38 and casing fluid inlet ports 40 (FIG. 3) as a function of the relative axial position of the valve stem 68 with respect to the valve body 34.

The valve stem 68 is comprised of a differential piston assembly 70 from which an elongated actuator mandrel 72 extends toward the check valve assembly 36. The actuator mandrel's 72 diameter is such that it does not fill the entire hollow interior volume of the valve body 34. As such, an interior volume 74 is defined within the valve body 34 that allows the casing fluid to flow into the interior of the valve body 34 via the casing fluid inlet ports 40 and from the interior of the valve body 34 into the interior of the tubing via the tubing outlet ports 38. This fluid flow, of course, subjects the interior portions of the valve body 34 to the pressures associated with such fluid flow; the ramifications of which is discussed below. Preferably, the differential piston assembly 70 has a first end portion 76, which is coupled to the valve stem 68 by cooperating female threads 78 on the first end portion 76 and male threads 80 on the end of the valve stem 68. The differential piston assembly 70 further includes an opposing second end portion 82 that has a smaller diameter area than the first end portion 76 and a reduced diameter portion 84 intermediate the first and second end portions 76,82 and that includes a cam support shoulder 87.

A hollow cylinder portion or compensation pressure chamber 88 is formed in the upper portion of the valve body 34 in which the differential piston assembly 70 is reciprocable. More preferably, the upper end of the chamber 88 is configured to allow the larger first end portion 76 of the differential piston assembly 70 to reciprocate within the upper end of the chamber 88. However, in the preferred embodiment, a shoulder 89 exists at the upper extremity of the chamber 88. When contacted by the upper surface of the larger first end portion 76, the shoulder 89 prevents further axial movement of valve stem assembly 68 in the upward direction.

A first seal 90, preferably an "O" ring, reinforced by an anti-extrusion ring 92, extends around the circumference of the first end portion 76 of the differential piston assembly 70 and a second seal 94, also preferably an "O" ring, reinforced by an anti-extrusion ring 92, extends around the second end portion 82. For reasons that will be discussed later, it is significant to point out that the first seal 90 has a diameter larger than that of the second seal 94. A control fluid chamber 96 is formed between the first end 76 and second end 82 of the differential piston assembly 70 and is sealed by the first and second seals 90 and 94. Additionally, the compensation pressure chamber 88 is formed between the upper wall of the chamber 88 and the first end portion 76 of the differential piston assembly 70 and is sealed from the control fluid chamber 96 by the first seal 90. The control fluid port 42, which is formed through the valve body 34 adjacent the control fluid chamber 96, allows a control fluid to be introduced into and released from the control fluid chamber 96 to reciprocate the valve stem 68 axially with respect to the valve body 34.

Extending around the circumference of the valve body's 34 upper portion and adjacent the chamber 88 is a first of three packing seals 44 comprising a pair of opposing "v" ring nesting profiles 98 having an "O" ring 100 between the opposing nesting profiles 98. Metallic rings 102 provide the needed "v" ring nesting profile to support the last ring of the nesting profile 98. When the valve assembly 24 is positioned in the mandrel pocket, the packing seal 44 is designed to form a seal between the inner wall of the mandrel pocket and the outer wall of the valve body 34.

Disposed within the valve body 34 is a cam 104. A cam is a rotating or sliding piece of any prescribed shape, or a projection of definite shape, such as on a wheel, either for imparting desired peculiar movement to a roller moving against its edge, to a pin free to move in a groove on its face, etc., or for receiving motion from such a roller, pin, etc. The cam 104, in a preferred embodiment, is a cylindrical sleeve member having first and second opposing ends 106,108. The cam 104 loosely circumscribes a portion of the tapered intermediate section 84 and is free floating and thus rotatable about the intermediate section 84. The cam 104 is rotatably held in position around the tapered intermediate section 84 between the cam shoulder 86 and the first end portion 76 of the differential piston assembly 70 and functions within the control fluid chamber 96. Thrust washers 110 are positioned on opposite ends of the cam 104 to reduce end to end friction. While the cam 104 is securely held in correct axial position in the manner just described, there is sufficient clearance between the outer wall of the cam 104 and the inner wall of the vale body 34 to allow the cam 104 to be free floating and thus rotatable about the intermediate section 84 of the differential piston assembly 70.

As will be later described in more detail, the cam 104 preferably has a plurality of interconnected pathways 112 spanning its circumference and together functioning as a camming surface. While the pathways 112 preferably form an interconnected zigzag pattern, it is appreciated that the pathways 112 may have a myriad of designs and configurations, depending on the engineering requirements of any given application. A follower 114, such as a guide lug, preferably extends from the interior wall of the valve body 34 into one of the plurality of pathways 112. The follower 114 effectively couples the cam 104 to the valve body 34 and causes the cam 104 to be rotatably indexed about the differential piston assembly 70 when the differential piston assembly 70 is reciprocated axially. An alternate embodiment may include a track and following device that follows a prescribed path to translate reciprocating axial movement of the piston assembly 70 to set the valve stem 68 at a predetermined axial position or displacement.

A body valve spring 116 is contained within the valve body 34 and is biased against the end of the valve stem 68. The body valve spring 116 is designed to overcome the control fluid static pressure head such that when applied control fluid pressure is not supplied to the body valve 34, the body valve spring 116 will be able to bias the valve stem 68 to a closed position even with the pressure head exerting a force toward the open position.

Figure 3C:
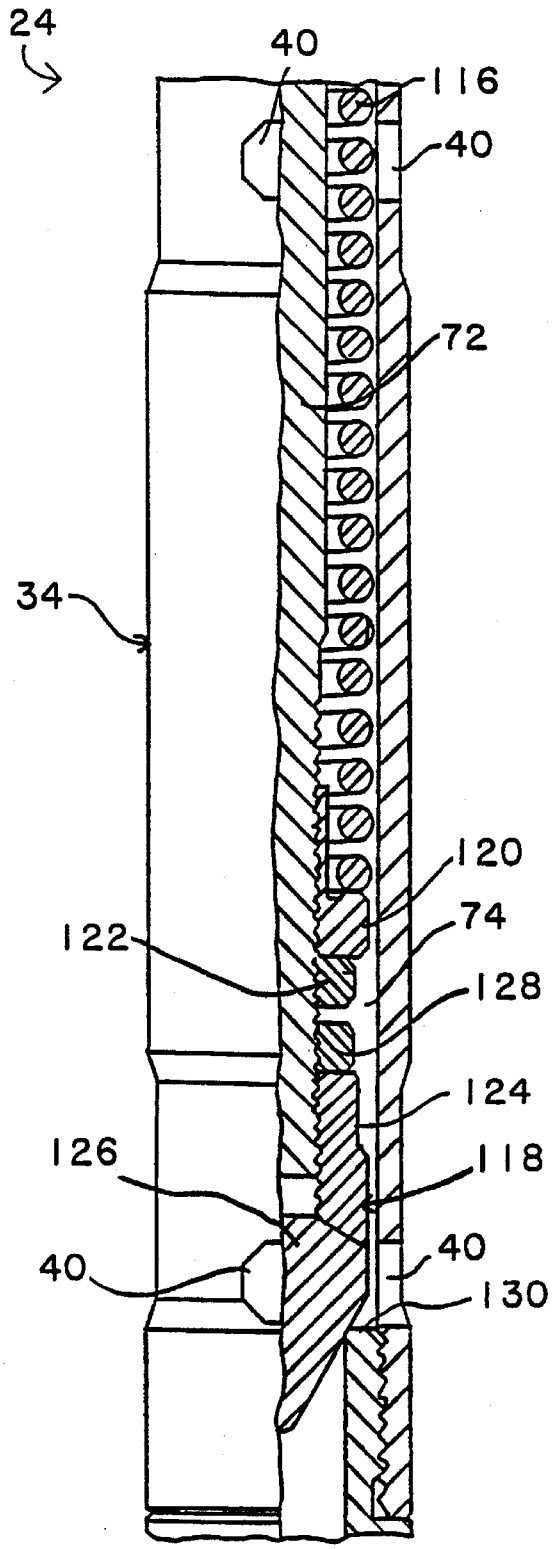
FIG. 3C illustrates a partial cut-away, cross-sectional view of the lower intermediate section of the valve illustrated in FIG. 3A.

Turning now to FIG. 3C, the body valve spring 116 extends to just adjacent a tapered valve stem head assembly 118. Immediately adjacent the end of the body valve spring 116 is a spring adjusting nut 120 that allows the tension of the body valve spring 116 to be adjusted as conditions require, and immediately adjacent the spring adjusting nut 120 is a spring locking nut 122 that prevents the spring adjusting nut 120 from changing position through vibrational rotation. Threadedly attached to the end of the actuator mandrel 72 is a valve stem head collar 124 that is attached to a tapered valve stem head 126. Adjacent the end of the valve stem head collar 124 is a threaded lock nut 128 that secures the valve stem head 126 in a set position. However, if so desired, the threaded lock nut 128 may be positioned to allow the valve stem head 126 to be adjusted to alter the axial setting of the cam 104. (FIG. 3B). The valve stem head 126 is shown in the closed position and engaged against the valve seat 130. While a tapered valve stem head and square-shouldered valve seat have been illustrated, it will, of course, be appreciated that other types of valves and seat valve configurations can be utilized in the present invention. Also illustrated in this figure are the casing fluid inlet ports 40 from the casing that communicate with the interior volume 74 of the valve body 34.

Figure 3D:
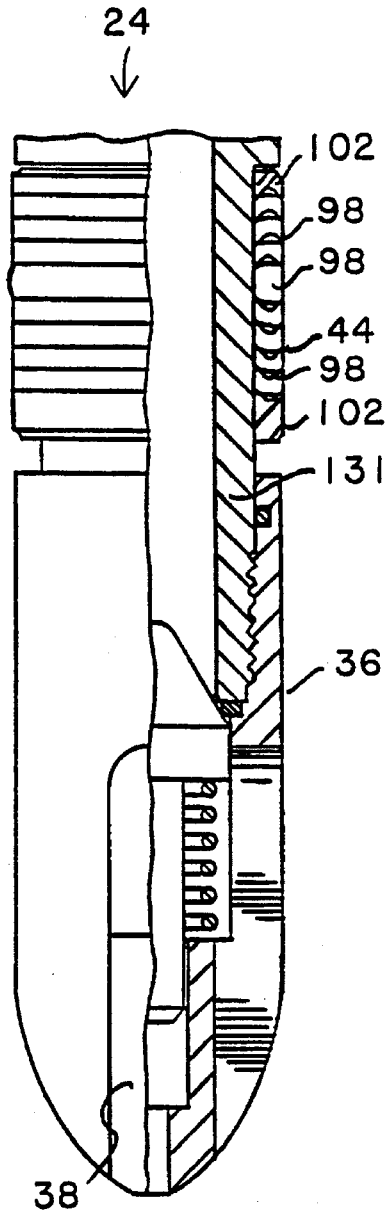
FIG. 3D illustrates a partial cut-away, cross-sectional view of the lower end section of the valve illustrated in FIG. 3A.
Figure 3E:
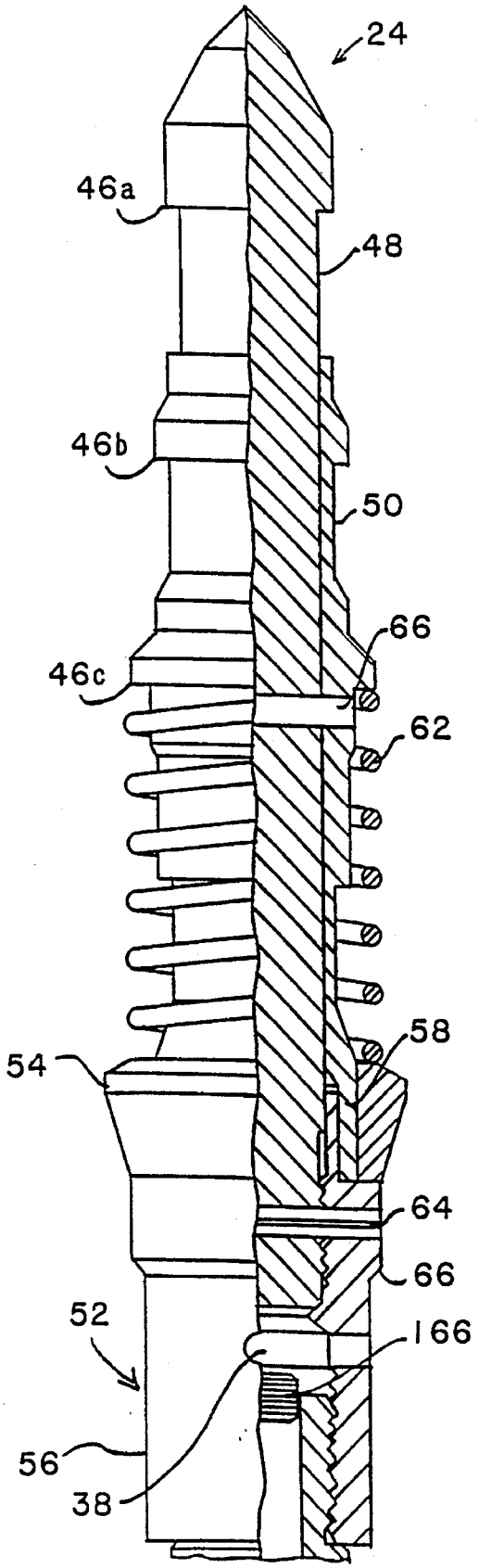
FIG. 3E illustrates a partial cut-away, cross-sectional view of another embodiment of the valve's upper portion having the opening to the tubing blocked and a passageway through the valve stem.
Figure 3F:
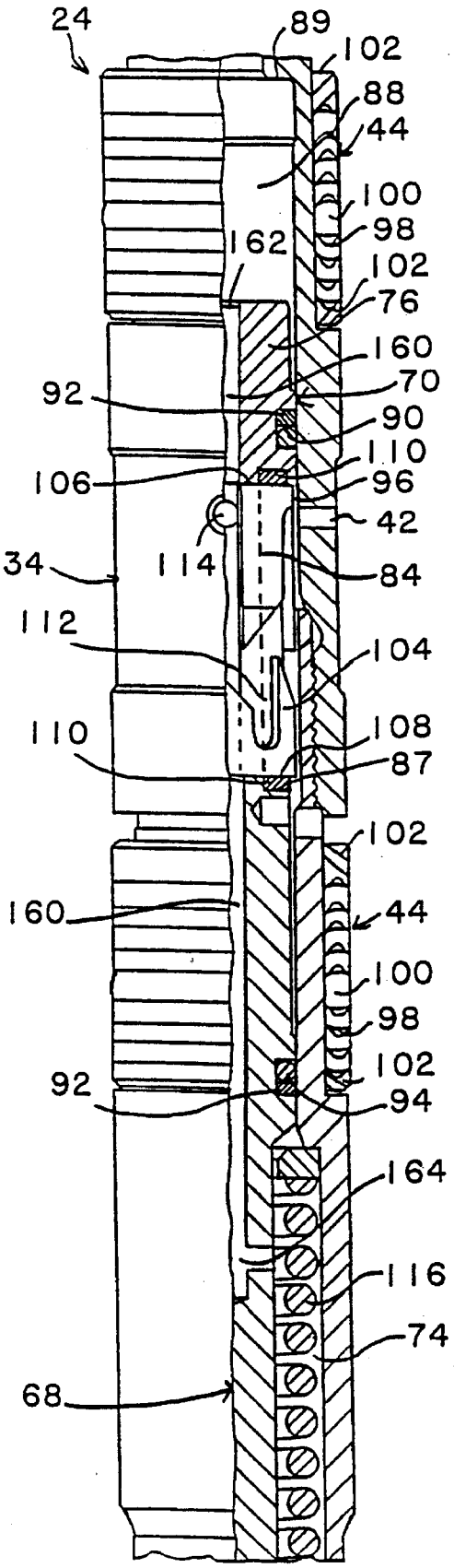
FIG. 3F illustrates a partial cut-away, cross-sectional view of the upper intermediate section of the valve illustrated in FIG. 3E.
Figure 3G:
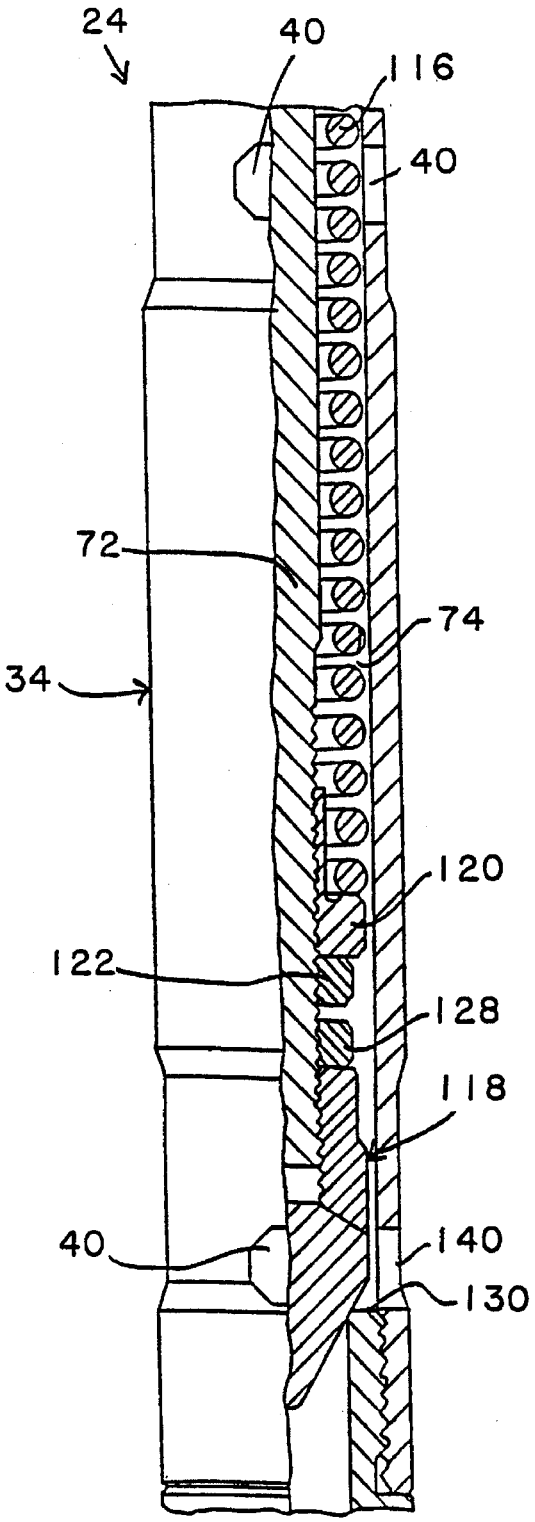
FIG. 3G illustrates a partial cut-away, cross-sectional view of the lower intermediate section of the valve illustrated in FIG. 3E.
Figure 3H:
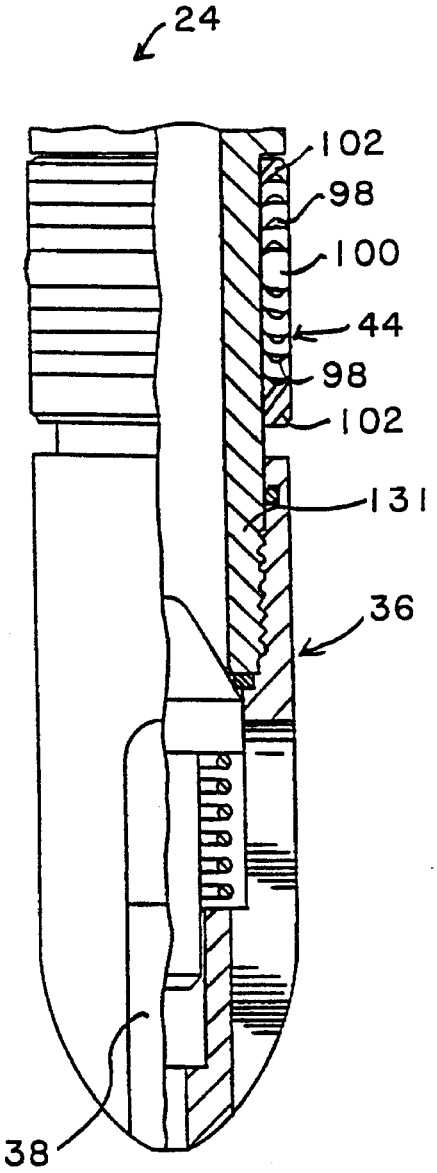
FIG. 3H illustrates a partial cut-away, cross-sectional view of the lower end section of the valve illustrated in FIG. 3E.

Briefly, FIG. 3D simply illustrates the conventional check valve assembly 36 having tubing fluid outlet ports 38 formed therein. The check valve assembly 36 is threadedly secured to the end of the valve seat body 131, and when the valve stem 126 is off-seat, it is in fluid communication with the interior volume 74 of the valve body 34.

With a preferred embodiment having been described, a preferred method of its operation will now be discussed with general reference to FIGS. 2, 3 through 3D, 4A through 4C, FIG. 5 and FIG. 6. The production tubing 18, the mandrel 28, and the control fluid line 30 are run into the casing 20 and set in position in a conventional manner. As previously stated, the valve assembly 24 is run into the production tubing 18 with a running tool, such as a wireline using conventional methods. The valve assembly's 24 downward motion is stopped by the no-go shoulder 66 contacting an opposing shoulder within the mandrel pocket 26. The lock collar 54 and the no-go shoulder 66 then cooperatively aid to position the valve assembly 24 in the mandrel pocket 26. As the valve assembly 24 is positioned in the mandrel pocket 26, the packing seals 44 seal against the interior wall of the pocket mandrel 26 to provide a fluid tight seal therebetween so that the control fluid can then be flowed into the valve body 34 through the casing fluid ports 40 without leaking into the production tubing 18. In effect, the packing seals 44, isolate the casing fluid from the tubing fluid such that fluids and their associated pressures can communicate only through the valve body 34.

Figure 5:
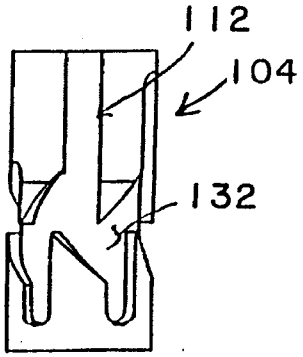
FIG. 5 illustrates the valve's cam portion having a J-slot about its circumference for providing a plurality of axial displacement positions for the valve stem.
Figure 6:
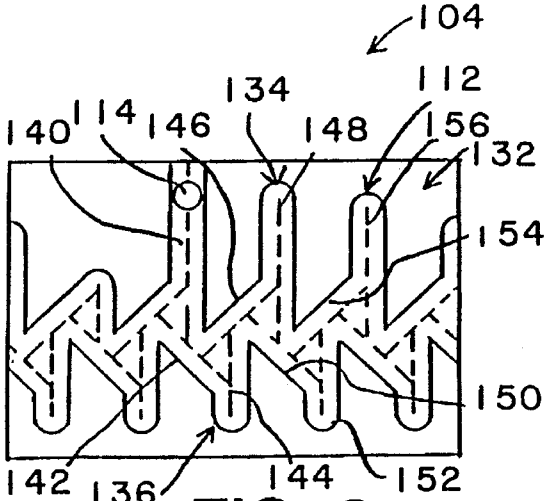
FIG. 6 illustrates a laid-out plan view of the cam illustrated in FIG. 5 showing the plurality of intermediate passages with a follower pin positioned therein for providing the plurality of axial displacement positions for the valve stem.

As the valve assembly 24 is set in the mandrel pocket 26, the valve stem head 126 may be biased to the closed position by the valve body spring 116. To unseat the valve stem head 126, the cam 104 is reciprocated and indexed to achieve the desired orifice setting. As mentioned above, the cam 104 is a cylindrical sleeve a pattern of pathways 112 spanning its circumference, which may vary in design depending on the application. Preferably, the pathways 112 form a zigzag pattern. A representative zigzag pattern 132 is illustrated in FIGS. 5 and 6 to which specific reference is now made. More preferably, the zigzag pattern 132 is preferably a J-slot configuration spanning the circumference of the cam 104 as illustrated in FIGS. 5 and 6. The J-slot is adapted to receive the follower 114 therein to govern the relative axial position of the valve stem 68 with respect to the valve body 34.

The pathways 112 of the J-slot configuration are comprised of a series of offset index paths 134 of varying length and intermediate stop paths 136 interconnected by angled indexing paths 138. The series of off-set stop paths 136 provide an axial stop position for the follower 114 when the control fluid pressure is applied, and the off-set index paths 134, which varying in length, provide an axial index position for the follower 114 when the control fluid pressure is relieved. The longer index paths 134 are designed to incrementally place the valve stem 68 in a selected axial position relative to the follower 114 when valve stem 68 is shifted axially with respect to the follower 114. The J-slot configuration can be configured to achieve a myriad of orifice size openings and may be aperiodic, if so desired that is they do not necessarily have to achieve orifice sizes represented by even number values. The size of the orifice depends on the length of the index path 134 as will now be further explained.

Figure 4D:
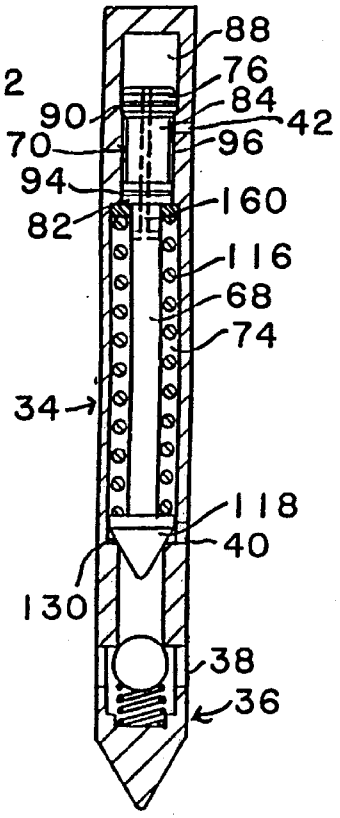
FIG. 4D illustrates a schematic cross-sectional view of the valve illustrated in FIGS. 3E–3H having the passageway formed through a portion of the valve stem.
Figure 4C:
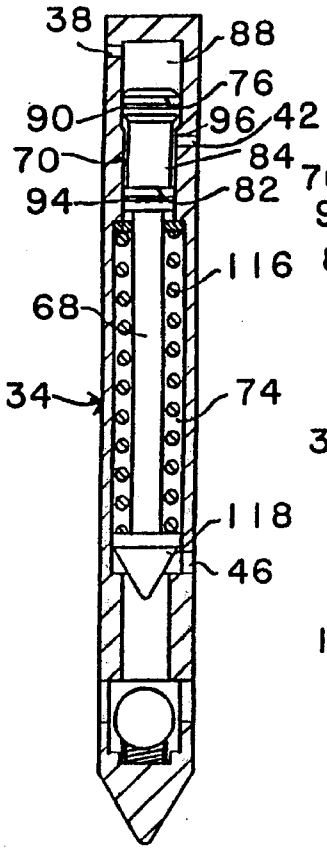
FIG. 4C illustrates a schematic cross-sectional view of the valve illustrated in FIGS. 3A–3D in a representative, partially open, operational position.
Figure 4B:
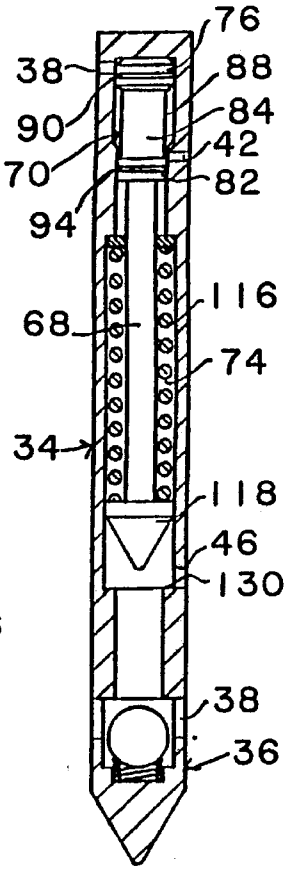
FIG. 4B illustrates a schematic cross-sectional view of the valve illustrated in FIGS. 3A–3D in the fully cocked position.
Figure 4A:
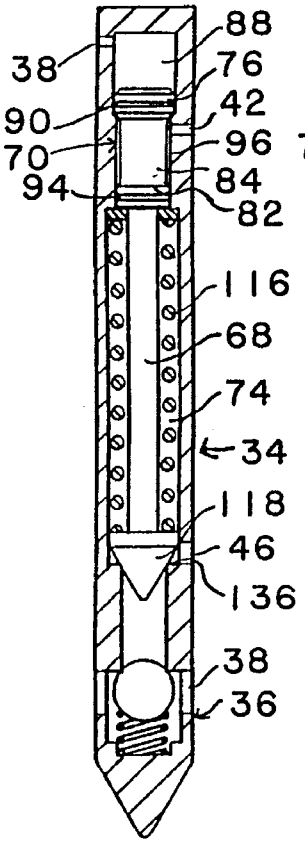
FIG. 4A illustrates a schematic cross-sectional view of the valve illustrated in FIGS. 3A–3D in the closed position.

The follower 114 is initially positioned in the closed position path 140, which allows the body valve spring 116 to bias the valve stem 68, and thus, the valve stem head 126 to a closed position as illustrated in FIG. 4A. As control fluid pressure is applied through the control fluid line 30 from a remote location and into the control fluid chamber 96, the fluid pressure acts on the first seal 90 and second seal 94 around the differential piston assembly 70. However, since the first seal 90 has the greater surface area, the force acting on seal 90 is greater than on seal 94 and a lifting force is created with respect to the valve stem 68 and valve stem head 126. As the control fluid pressure is increased, the lift force overcomes the resistance provided by the body valve spring 116 and drives the differential piston assembly 70, the valve stem 68 and the valve stem head 126 to a fully open position, as illustrated in FIG. 4B. Since the cam 104 is coupled to the differential piston assembly 70 in the manner previously described, the cam 104 also moves in the same direction as the differential piston assembly 70.

As the cam 104 moves, the follower 114 traverses its initial closed path 140 (FIG. 6) until it engages a first angled surface 142. As the first angled surface 142 is engaged, the follower's 114 angle of incidence on the first angled surface 142 causes the cam 104 to rotate with respect to the valve body 34 until the follower 114 is positioned in a cocked position within a first stop pathway 144 (FIG. 6). In a preferred embodiment, the rotational direction of the cam 104 is clockwise, however, it will of course be appreciated that the design could be configured to rotate in a counter-clockwise direction.

When the control fluid pressure is relieved at the remote location, the control fluid pressure is abated in the control fluid chamber 96. With a substantial control fluid pressure no longer present, the body valve spring 116 then forces the valve stem 68 and the cam 104 toward the closed position. As the cam 104 moves in this manner, the follower 114 then engages a second angled surface 146 (FIG. 6). The follower's 114 angle of incidence on the second angled surface 146 causes the cam 104 to rotate, which engages the follower 114 to a first index path 148. The follower 114 encounters the end of the first index path 148, and this position is held by the biasing force exerted against the valve stem 68 by the body valve spring 116. The first index path 148 has a shorter length than the initial path 140, which axially adjusts the valve stem 68 away from the valve seat 130 and thus leaves the valve stem head 126 unseated and in a partial open position as illustrated in FIG. 4C.

When the control fluid pressure is again applied, the valve stem 68 and the cam 104 reciprocate toward a fully open position which causes the follower 114 to track from the first index path 148 toward a third angled surface 150. The follower's 114 angle of incidence rotates the cam 104 sufficiently to cause the follower 114 to traverse to a second stop position 152. When the control fluid pressure is relieved, the cam 104 reciprocates and causes the follower 114 to track toward and engage a fourth angled surface 154. The follower's 114 angle of incidence rotates the cam 104 sufficiently to cause the follower 114 to traverse a second index path 156. The follower 114 encounters the end of the second index path 156, and this position is maintained by the force exerted against the valve stem 68 by the valve body spring 116. The second index path 156 has a shorter length than the first index path 148, which causes the orifice to be larger than the orifice corresponding to the first index position 148.

The cam 104 can be indexed in this same manner to a third index position 158 or more positions, depending on the design of the cam 104 until the cam 104 has made a complete revolution to return the follower 114 to its initial closed position 140. Each index path 134 that the follower 114 rests in increases the size of the orifice. Thus, the size of the orifice can be precisely controlled from a remote location via the utilization of a control fluid.

Another preferred embodiment of valve assembly of the present invention is illustrated in FIGS. 3E through 3H and FIGS. 4D. The valve assembly 24 represented in these figures is identical to the valve assembly 24 previously discussed above and illustrated in FIGS. 3 through 3D with one difference. That difference is that the differential piston assembly 70 and a portion of the length of the valve stem 68 have a compensation pressure port 160 extending therethrough. As illustrated, the compensation pressure port 160 has a first opening 162 that opens outwardly into the chamber 88 and extends through the differential piston assembly 70 and a portion of the length of the actuator mandrel 72. The compensation pressure port 160 also has a second opening 164 that opens into the hollow portion of the interior volume 74 of the valve body 34. This places the chamber 88 and the interior volume 74 of the valve body 34 in fluid communication with each other. It should be noted that a thread pressure plug 166 blocks fluid communication between the chamber 88 and the tubing fluid outlet port 38. Thus, the differential piston assembly 70 in this particular embodiment is no longer suspectable to the pressure exerted by the fluid in the tubing. In situations where there is a high pressure differential between the casing and tubing, this could be a significant advantage in the efficient operation of the valve.

Reference will now be made to FIGS. 4A through 4D. In the previous embodiment as illustrated in FIGS. 4A through 4C, there are several forces involved. First, the chamber 88 is open to the tubing, which exerts a downward force on the first end portion of the differential piston assembly 70. Second, there is the valve body spring 116 that is exerting a force on the valve stem 68 toward the closed position. Third, the hydrostatic pressure from the control fluid exerts an upward force on the differential piston assembly 70 toward an open position. Fourth, the casing pressure exerts a upward force on the second end portion 82 of the differential piston assembly 70. As long as the difference between the forces generated by the tubing pressure and casing pressure acting on the piston assembly 70 is within prescribed limits, the valve functions properly. However, in those instances where the casing pressure becomes much greater than the tubing pressure, and particularly if the casing pressure is also lower than the hydrostatic pressure in the fluid control conduit, then these differentials can prevent the valve stem 68 from working properly. If the casing to tubing differential pressure is great enough, it may prevent the valve from indexing properly. To index the mechanism fully, the forces working to stroke the valve stem 68 must overcome those forces resisting. As seen in FIGS. 4A through 4C, the pressure in the hydraulic line times the difference in area of the first end and second end portions 76 and 82 of the differential piston assembly 70 must be greater than the sum of the effects of: the body valve spring force, tubing pressure acting on the first end portion 76, casing pressure acting on the second end portion 82, friction of the device, and if the valve is on valve seat 130, the tubing/casing pressure difference times the area of the valve seat. To complete the indexing cycle, the forces biasing the valve stem 68 back toward the valve seat 130 must prevail once the control fluid pressure applied at the remote location is removed. In applications in which casing pressure is significantly greater than tubing pressure, the valve illustrated in FIGS. 4A–4C may be inadequate to prevent the valve stem 68 from floating in the valve body 34 and therefore changing the orifice size. On the other hand, if tubing pressure becomes significantly larger than the casing pressure, the control fluid may not be able to overcome the excessive pressure exerted by the tubing pressure, thereby causing the valve to malfunction.

However, in the embodiment illustrated in FIG. 4D, the first end portion 76 of the differential piston assembly 70 is not subject to the tubing pressure and the valve body 34 and the valve stem 68 define a compensation pressure chamber at an end distal to the process fluid outlet wherein the valve stem 68 includes a compensation pressure port 160 allowing fluid communication between the compensation pressure chamber 88 and the interior of the valve body 34, which is open to the casing pressure. In such applications, casing pressure may be introduced into the compensation pressure chamber 88 via the compensation pressure port 160 to nullify any sensitivity whatsoever to the pressure differential between tubing and casing. The nullification comes from the casing pressure's ability to exert a downward force on the larger surface area of the first end portion 76 of the differential piston assembly 70.

Figure 4E:
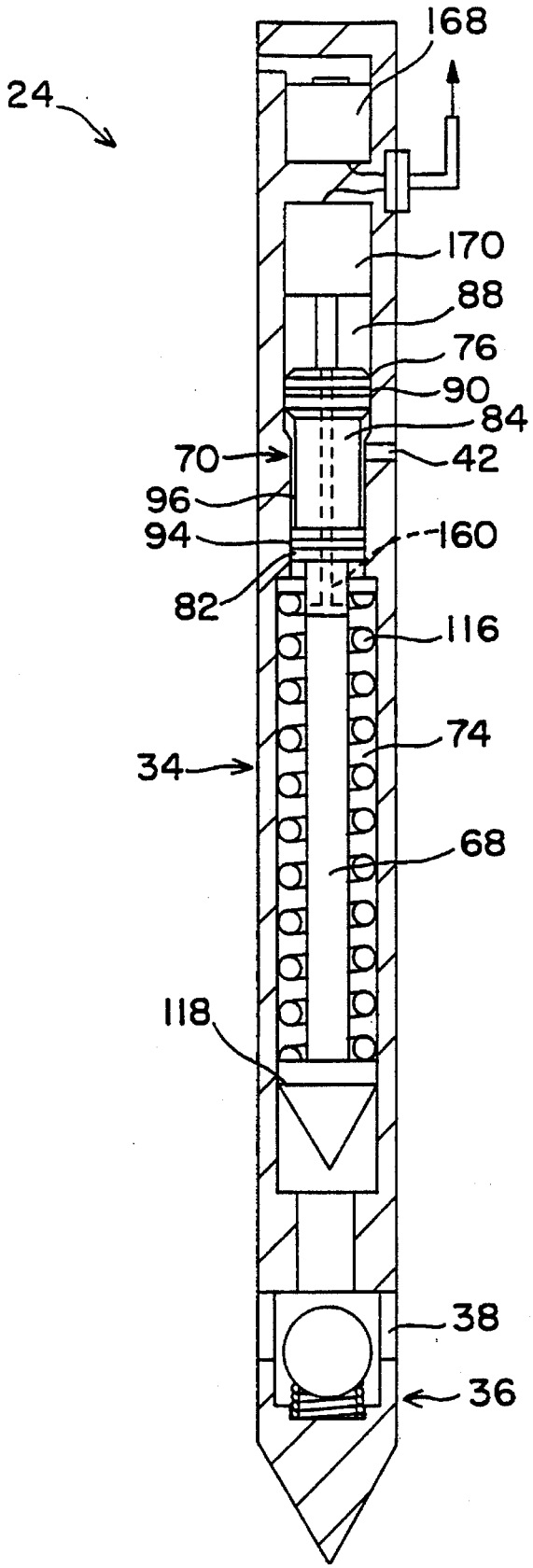
FIG. 4E illustrates a schematic cross-sectional view of the valve illustrated in FIG. 4D having a tubing pressure transducer, and a valve stem axial displacement transducer.

Turning now to FIG. 4E, there is yet another embodiment of the valve of the present invention that may include a tubing pressure transducer 168 or a valve stem axial displacement transducer 170 for relaying data concerning the valve to a remote location. With respect to these measuring devices, a significant advantage of this aspect of the present invention is that it is highly desirable in downhole flow control valve systems to have an accurate system for monitoring not only the orifice size of the valve but the pressure of the production tubing to obtain desired production parameters within the well. For example, it is advantageous to select a particular bottom hole pressure and then control the size of the orifice of the valve to obtain that selected value of bottom hole pressure. Such systems require a reliable means for both sending data uphole from the vicinity of the valve as well as processing that data and then actively controlling the size of the flow control orifice of the valve to obtain the desired results, as monitored by the system.

In this preferred embodiment, the valve provides transducers for sensing the displacement of the valve stem (and hence orifice size) and the tubing pressure. Of course, other sensors, such as a flow rate transducer, are within the broad scope of the present invention.

From the above, it is apparent that the present invention provides a remotely-adjustable valve employable in an enhanced-lift recovery system and a method of adjusting the same. The valve comprises: (1) an elongated valve body having a process fluid inlet and a process fluid outlet, (2) an elongated valve stem disposed within the valve body for axial displacement relative thereto to adjust a rate of process fluid flow between the fluid inlet and the fluid outlet as a function of a relative axial position of the valve stem with respect to the valve body and (3) a cam disposed within the valve body and coupling the valve body and the valve stem, the cam providing a plurality of axial displacement positions thereon to place the valve stem at a selected one of a plurality of relative axial positions with respect to the valve body, the valve body having a control fluid pressure port for allowing a control fluid pressure to be introduced into and released from the valve to reciprocate the valve stem axially with respect to the valve body between cocked and set positions, the cam moving from a first axial displacement position to a second axial displacement position as the valve stem is reciprocated, a difference between the first and second axial displacement positions thereby causing an adjustment of the rate of process fluid flow between the fluid inlet and the fluid outlet.

Although the present invention and its advantages have been described in detail, those skilled in the art should understand that they can make various changes, substitutions and alterations herein without departing from the spirit and scope of the invention in its broadest form.

What is claimed:

1. A remotely-adjustable valve employable in an enhanced-lift recovery system, comprising:

an elongated valve body having a process fluid inlet and a process fluid outlet;

an elongated valve stem disposed within said valve body for axial displacement relative thereto to adjust a rate of process fluid flow between said fluid inlet and said fluid outlet as a function of a relative axial position of said valve stem with respect to said valve body;

a cam disposed within said valve body and coupling said valve body and said valve stem, said cam providing a plurality of axial displacement positions thereon to place said valve stem at a selected one of a plurality of relative axial positions with respect to said valve body, said valve body having a control fluid pressure port for allowing a control fluid pressure to be introduced into and released from said valve to reciprocate said valve stem axially with respect to said valve body between cocked and set positions, said cam moving from a first axial displacement position to a second axial displacement position as said valve stem is reciprocated, a difference between said first and second axial displacement positions thereby causing an adjustment of said rate of process fluid flow between said fluid inlet and said fluid outlet.

2. The valve as recited in claim 1 wherein said cam is rotatable and provided with a J-slot about a circumference thereof, said J-slot adapted to receive a follower therein to govern said relative axial position of said valve stem with respect to said valve body, said J-slot having a plurality of intermediate passages coupling said plurality of axial displacement positions.

3. The valve as recited in claim 1 further comprising a follower coupling said valve stem to said valve body.

4. The valve as recited in claim 1 wherein said valve stem comprises a differential piston, said differential piston being reciprocable within a chamber of said valve body and defining a control fluid chamber about said differential piston, introduction of said control fluid pressure into said control fluid chamber causing said valve stem to move into a cocked position.

5. The valve as recited in claim 1 wherein said valve body and said valve stem define a compensation pressure chamber at an end distal to said process fluid outlet, said valve body including a compensation pressure port allowing fluid communication between said compensation pressure chamber and an environment surrounding said distal end.

6. The valve as recited in claim 1 wherein said valve body and said valve stem define a compensation pressure chamber at an end distal to said process fluid outlet, said valve stem including a compensation pressure port allowing fluid communication between said compensation pressure chamber and an environment surrounding said process fluid inlet.

7. The valve as recited in claim 1 wherein said cam provides at more than one axial displacement positions thereon.

8. The valve as recited in claim 1 wherein said cam provides an axial displacement position in which said valve stem closes said valve.

9. The valve as recited in claim 1 wherein said valve body is operable to be disposed within a side pocket mandrel associated with a well flow conductor.

10. The valve as recited in claim 1 further comprising a spring biasing said valve stem toward a closed position with respect to said valve body.

11. The valve as recited in claim 1 further comprising a remote source of controllable hydraulic pressure coupled to said control fluid pressure port, said remote source capable of establishing and interrupting a prescribed pressure to reciprocate said valve stem within said valve body.

12. The valve as recited in claim 1 further comprising a sensor for relaying data concerning said valve to a remote location, said sensor selected from the group consisting of:

a tubing pressure transducer, and a valve stem axial displacement transducer.

13. The valve as recited in claim 1 wherein said process fluid inlet communicates with a casing of a subterranean well.

14. The valve as recited in claim 1 wherein said process fluid outlet communicates with production tubing located within a casing of a subterranean well.

15. The valve as recited in claim 1 further comprising a check valve to prevent substantial process fluid flow from said process fluid outlet to said process fluid inlet.

16. The valve as recited in claim 1 wherein said control fluid pressure is produced by a control fluid selected from the group consisting of hydraulic fluid and gas.

17. The valve as recited in claim 1 wherein first and second annular seals disposed about said valve body cooperate with a mandrel surrounding said valve body to create an annular chamber to receive a control fluid for introduction into said valve via said control fluid pressure port.

18. The valve as recited in claim 1 further comprising a running/pulling tool coupled to an end of said valve body distal to said process fluid outlet, said valve removably locatable in a mandrel within a subterranean well.

19. The valve as recited in claim 1 wherein said valve is located in a side pocket mandrel associated with production tubing in a subterranean well, a casing surrounding said production tubing adapted to receive a process fluid and transfer said process fluid to within said production tubing at said rate of process fluid flow via said valve.

20. A method of remotely adjusting a valve employable in an enhanced-lift recovery system, comprising the steps of:

introducing a control fluid pressure into a control fluid pressure port in an elongated valve body, said valve body having a process fluid inlet and a process fluid outlet;

axially displacing an elongated valve stem disposed within said valve body from a first set position to a cocked position, said valve stem axially displaceable relative to said valve body to adjust a rate of process fluid flow between said fluid inlet and said fluid outlet as a function of a relative axial position of said valve stem with respect to said valve body;

moving a cam from a first axial displacement position to an intermediate position with said valve stem, said cam disposed within said valve body and coupling said valve body and said valve stem, said cam providing a plurality of axial displacement positions thereon to place said valve stem at a selected one of a plurality of relative axial positions with respect to said valve body; and releasing said control fluid pressure, said valve stem moving said cam from said intermediate position to a second axial displacement position, a difference in said first and second axial displacement positions thereby causing an adjustment of said rate of process fluid flow between said fluid inlet and said fluid outlet.

21. The method as recited in claim 20 wherein said step of moving comprises the step of rotating said cam, said cam provided with a J-slot about a circumference thereof, said J-slot adapted to receive a follower therein to govern said relative axial position of said valve stem with respect to said valve body, said J-slot having a plurality of intermediate passages coupling said plurality of axial displacement positions.

22. The method as recited in claim 20 wherein said step of moving comprises the step of sliding, with respect to said cam, a follower coupling said valve body to said cam.

23. The method as recited in claim 20 wherein said valve stem comprises a differential piston, said differential piston being reciprocable within a chamber of said valve body and defining a control fluid chamber about said differential piston, said step of axially displacing comprising the step of introducing of said control fluid pressure into said control fluid chamber, thereby causing said valve stem to move into a cocked position.

24. The method as recited in claim 20 wherein said valve body and said valve stem define a compensation pressure chamber at an end distal to said process fluid outlet, said method further comprising the step of allowing fluid communication, via a compensation pressure port associated with said valve body, between said compensation pressure chamber and an environment surrounding said distal end.

25. The method as recited in claim 20 wherein said valve body and said valve stem define a compensation pressure chamber at an end distal to said process fluid outlet, said method further comprising the step of allowing fluid communication, via a compensation pressure port associated with said valve stem, between said compensation pressure chamber and an environment surrounding said process fluid inlet.

26. The method as recited in claim 20 wherein said cam provides at least three axial displacement positions thereon.

27. The method as recited in claim 20 wherein said cam provides an axial displacement position in which said valve stem closes said valve, said method further comprising the step of closing said valve with said valve stem.

28. The method as recited in claim 20 further comprising the step of disposing said valve within a side pocket mandrel associated with a well flow conductor.

29. The method as recited in claim 20 further comprising the step of biasing said valve stem toward a closed position with respect to said valve body with a spring.

30. The method as recited in claim 20 further comprising the step of establishing and interrupting a prescribed pressure to reciprocate said valve stem within said valve body with a remote source of controllable hydraulic pressure coupled to said control fluid pressure port.

31. The method as recited in claim 20 further comprising the step of relaying data concerning said valve from a sensor to a remote location, said sensor selected from the group consisting of:

a tubing pressure transducer, and a valve stem axial displacement transducer.

32. The method as recited in claim 20 further comprising the step of communicating fluid between said process fluid inlet and a casing of a subterranean well.

33. The method as recited in claim 20 further comprising the step of communicating fluid between said process fluid outlet and production tubing located within a casing of a subterranean well.

34. The method as recited in claim 20 further comprising the step of preventing substantial process fluid flow from said process fluid outlet to said process fluid inlet with a check valve.

35. The method as recited in claim 20 wherein said control fluid pressure is produced by a control fluid selected from the group consisting of hydraulic fluid and gas.

36. The method as recited in claim 20 wherein first and second annular seals disposed about said valve body cooperate with a mandrel surrounding said valve body to create an annular chamber, said method further comprising the step of receiving a control fluid into said annular chamber for introduction into said valve via said control fluid pressure port.

37. The method as recited in claim 20 further comprising the step of coupling a running/pulling tool to an end of said valve body distal to said process fluid outlet, said valve removably locatable in a mandrel within a subterranean well.

38. The method as recited in claim 20 wherein said valve is located in a side pocket mandrel associated with production tubing in a subterranean well, said method further comprising the steps of:

receiving a process fluid into a casing surrounding said production tubing; and transferring said process fluid to within said production tubing at said rate of process fluid flow via said valve.

39. A remotely-adjustable valve employable in an enhanced-lift recovery system, comprising:

an elongated valve body having a process fluid inlet and a process fluid outlet;

an elongated valve stem disposed within said valve body for axial displacement relative thereto to adjust a rate of process fluid flow between said fluid inlet and said fluid outlet as a function of a relative axial position of said valve stem with respect to said valve body, said valve body and said valve stem defining a compensation pressure chamber at an end distal to said process fluid outlet, said valve stem including a compensation pressure port allowing fluid communication between said compensation pressure chamber and an environment surrounding said process fluid inlet;

a cam disposed within said valve body and coupling said valve body and said valve stem, said cam providing a plurality of axial displacement positions thereon to place said valve stem at a selected one of a plurality of relative axial positions with respect to said valve body, said valve body having a control fluid pressure port for allowing a control fluid pressure to be introduced into and released from said valve to reciprocate said valve stem axially with respect to said valve body between cocked and set positions, said cam moving from a first axial displacement position to a second axial displacement position as said valve stem is reciprocated, a difference between said first and second axial displacement positions thereby causing an adjustment of said rate of process fluid flow between said fluid inlet and said fluid outlet.

40. The valve as recited in claim 39 wherein said cam is rotatable and provided with a J-slot about a circumference thereof, said J-slot adapted to receive a follower therein to govern said relative axial position of said valve stem with respect to said valve body, said J-slot having a plurality of intermediate passages coupling said plurality of axial displacement positions.

41. The valve as recited in claim 39 further comprising a follower coupling said valve body to said cam.

42. The valve as recited in claim 39 wherein said valve stem comprises a differential piston, said differential piston being reciprocable within a chamber of said valve body and defining a control fluid chamber about said differential piston, introduction of said control fluid pressure into said control fluid chamber causing said valve stem to move into a cocked position.

43. The valve as recited in claim 39 wherein said plurality of axial displacement positions are aperiodically distributed.

44. The valve as recited in claim 39 further comprising a sensor for relaying data concerning said valve to a remote location, said sensor selected from the group consisting of:

a tubing pressure transducer, and a valve stem axial displacement transducer.

45. The valve as recited in claim 39 wherein said cam provides more than one axial displacement positions thereon.

46. The valve as recited in claim 39 wherein said cam provides an axial displacement position in which said valve stem closes said valve.

47. The valve as recited in claim 39 wherein said valve body is operable to be disposed within a side pocket mandrel associated with a well flow conductor.

48. The valve as recited in claim 39 further comprising a spring biasing said valve stem toward a closed position with respect to said valve body.

49. The valve as recited in claim 39 further comprising a remote source of controllable hydraulic pressure coupled to said control fluid pressure port, said remote source capable of establishing and interrupting a prescribed pressure to reciprocate said valve stem within said valve body.

50. The valve as recited in claim 39 wherein a process fluid is a gas.

51. The valve as recited in claim 39 wherein said process fluid inlet communicates with a casing of a subterranean well.

52. The valve as recited in claim 39 wherein said process fluid outlet communicates with production tubing located within a casing of a subterranean well.

53. The valve as recited in claim 39 further comprising a check valve to prevent substantial process fluid flow from said process fluid outlet to said process fluid inlet.

54. The valve as recited in claim 39 wherein said control fluid pressure is produced by a control fluid selected from the group consisting of hydraulic fluid and gas.

55. The valve as recited in claim 39 wherein first and second annular seals disposed about said valve body cooperate with a mandrel surrounding said valve body to create an annular chamber to receive a control fluid for introduction into said valve via said control fluid pressure port.

56. The valve as recited in claim 39 further comprising a running/pulling tool coupled to an end of said valve body distal to said process fluid outlet, said valve removably locatable in a mandrel within a subterranean well.

57. The valve as recited in claim 39 wherein said valve is located in a side pocket mandrel associated with production tubing in a subterranean well, a casing surrounding said production tubing adapted to receive a process fluid and transfer said process fluid to within said production tubing at said rate of process fluid flow via said valve.

58. A method of remotely adjusting a valve employable in an enhanced-lift recovery system, comprising the steps of:

introducing a control fluid pressure into a control fluid pressure port in an elongated valve body, said valve body having a process fluid inlet and a process fluid outlet;

axially displacing an elongated valve stem disposed within said valve body from a first set position to a cocked position, said valve stem axially displaceable relative to said valve body to adjust a rate of process fluid flow between said fluid inlet and said fluid outlet as a function of a relative axial position of said valve stem with respect to said valve body, said valve body and said valve stem defining a compensation pressure chamber at an end distal to said process fluid outlet, said valve stem including a compensation pressure port allowing fluid communication between said compensation pressure chamber and an environment surrounding said process fluid inlet;

moving a cam from a first axial displacement position to an intermediate position with said valve stem, said cam disposed within said valve body and coupling said valve body and said valve stem, said cam providing a plurality of axial displacement positions thereon to place said valve stem at a selected one of a plurality of relative axial positions with respect to said valve body; and releasing said control fluid pressure, said valve stem moving said cam from said intermediate position to a second axial displacement position, a difference in said first and second axial displacement positions thereby causing an adjustment of said rate of process fluid flow between said fluid inlet and said fluid outlet.

59. The method as recited in claim 58 wherein said step of moving comprises the step of rotating said cam, said cam provided with a J-slot about a circumference thereof, said J-slot adapted to receive a follower therein to govern said relative axial position of said valve stem with respect to said valve body, said J-slot having a plurality of intermediate passages coupling said plurality of axial displacement positions.

60. The method as recited in claim 58 wherein said step of moving comprises the step of sliding, with respect to said cam, a follower coupling said valve stem to said cam.

61. The method as recited in claim 58 wherein said valve stem comprises a differential piston, said differential piston being reciprocable within a chamber of said valve body and defining a control fluid chamber about said differential piston, said step of axially displacing comprising the step of introducing of said control fluid pressure into said control fluid chamber, thereby causing said valve stem to move into a cocked position.

62. The method as recited in claim 58 wherein said plurality of axial displacement positions are aperiodically distributed.

63. The method as recited in claim 58 further comprising the step of relaying data concerning said valve from a sensor to a remote location, said sensor selected from the group consisting of:

a tubing pressure transducer, and a valve stem axial displacement transducer.

64. The method as recited in claim 58 wherein said cam provides at least three axial displacement positions thereon.

65. The method as recited in claim 58 wherein said cam provides an axial displacement position in which said valve stem closes said valve, said method further comprising the step of closing said valve with said valve stem.

66. The method as recited in claim 58 further comprising the step of disposing said valve within a side pocket mandrel associated with a well flow conductor.

67. The method as recited in claim 58 further comprising the step of biasing said valve stem toward a closed position with respect to said valve body with a spring.

68. The method as recited in claim 58 further comprising the step of establishing and interrupting a prescribed pressure to reciprocate said valve stem within said valve body with a remote source of controllable hydraulic pressure coupled to said control fluid pressure port.

69. The method as recited in claim 58 further comprising the step of relaying data concerning said valve from a sensor to a remote location, said sensor selected from the group consisting of:

a tubing pressure transducer, and a valve stem axial displacement transducer.

70. The method as recited in claim 58 further comprising the step of communicating fluid between said process fluid inlet and a casing of a subterranean well.

71. The method as recited in claim 58 further comprising the step of communicating fluid between said process fluid outlet and production tubing located within a casing of a subterranean well.

72. The method as recited in claim 58 further comprising the step of preventing substantial process fluid flow from said process fluid outlet to said process fluid inlet with a check valve.

73. The valve as recited in claim 58 wherein said control fluid pressure is produced by a control fluid selected from the group consisting of hydraulic fluid and gas.

74. The method as recited in claim 58 wherein first and second annular seals disposed about said valve body cooperate with a mandrel surrounding said valve body to create an annular chamber, said method further comprising the step of receiving a control fluid into said annular chamber for introduction into said valve via said control fluid pressure port.

75. The method as recited in claim 58 further comprising the step of coupling a running/pulling tool to an end of said valve body distal to said process fluid outlet, said valve removably locatable in a mandrel within a subterranean well.

76. The method as recited in claim 58 wherein said valve is located in a side pocket mandrel associated with production tubing in a subterranean well, said method further comprising the steps of:

receiving a process fluid into a casing surrounding said production tubing; and transferring said process fluid to within said production tubing at said rate of process fluid flow via said valve.

77. A remotely-adjustable valve employable in an enhanced-lift recovery system, comprising:

an elongated valve body having a process fluid inlet and a process fluid outlet;

an elongated valve stem disposed within said valve body for axial displacement relative thereto to adjust a rate of process fluid flow between said fluid inlet and said fluid outlet as a function of a relative axial position of said valve stem with respect to said valve body;

a cam follower disposed within said valve body and coupling said valve body and said valve stem, said cam follower following a prescribed path defined by a camming surface within said valve body to translate a reciprocating axial movement of said valve stem to set said valve stem at a predetermined axial displacement, said valve body having a control fluid pressure port for allowing a control fluid pressure to be introduced into and released from said valve to reciprocate said valve stem axially with respect to said valve body between cocked and set positions, said cam follower following said camming surface from a first axial displacement position to a second axial displacement position as said valve stem is reciprocated, a difference between said first and second axial displacement positions thereby causing an adjustment of said rate of process fluid flow between said fluid inlet and said fluid outlet.

78. The valve as recited in claim 77 wherein said valve stem comprises a differential piston, said differential piston being reciprocable within a chamber of said valve body and defining a control fluid chamber about said differential piston, introduction of said control fluid pressure into said control fluid chamber causing said valve stem to move into a cocked position.

79. The valve as recited in claim 77 wherein said valve body and said valve stem define a compensation pressure chamber at an end distal to said process fluid outlet, said valve body including a compensation pressure port allowing fluid communication between said compensation pressure chamber and an environment surrounding said distal end.

80. The valve as recited in claim 77 wherein said valve body and said valve stem define a compensation pressure chamber at an end distal to said process fluid outlet, said valve stem including a compensation pressure port allowing fluid communication between said compensation pressure chamber and an environment surrounding said process fluid inlet.

81. The valve as recited in claim 77 further comprising a remote source of controllable hydraulic pressure coupled to said control fluid pressure port, said remote source capable of establishing and interrupting a prescribed pressure to reciprocate said valve stem within said valve body.

82. The valve as recited in claim 77 further comprising a sensor for relaying data concerning said valve to a remote location, said sensor selected from the group consisting of:

a tubing pressure transducer, and a valve stem axial displacement transducer.

83. The valve as recited in claim 77 further comprising a check valve to prevent substantial process fluid flow from said process fluid outlet to said process fluid inlet.

84. The valve as recited in claim 77 wherein said control fluid pressure is produced by a control fluid selected from the group consisting of hydraulic fluid and gas.

* * * * *